US011846907B2

(12) United States Patent
Obana

(10) Patent No.: US 11,846,907 B2
(45) Date of Patent: Dec. 19, 2023

(54) IMAGE FORMING APPARATUS HAVING POWER SUPPLY HARNESS

(71) Applicant: Akimitsu Obana, Kanagawa (JP)

(72) Inventor: Akimitsu Obana, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 18/083,695

(22) Filed: Dec. 19, 2022

(65) Prior Publication Data

US 2023/0266707 A1 Aug. 24, 2023

(30) Foreign Application Priority Data

Feb. 22, 2022 (JP) ..... 2022-025619

(51) Int. Cl.
*G03G 21/00* (2006.01)
*G03G 15/00* (2006.01)
*G03G 21/16* (2006.01)

(52) U.S. Cl.
CPC ..... *G03G 15/80* (2013.01); *G03G 15/5004* (2013.01); *G03G 21/1652* (2013.01); *G03G 21/1633* (2013.01); *G03G 2221/166* (2013.01); *G03G 2221/1639* (2013.01); *G03G 2221/1654* (2013.01)

(58) Field of Classification Search
CPC ..... G03G 15/80; G03G 15/5004; G03G 21/1652; G03G 2221/166; G03G 21/1633; G03G 2221/1684; G03G 2221/169
USPC ..... 399/90
See application file for complete search history.

(56) References Cited

U.S. PATENT DOCUMENTS

2007/0242983 A1* 10/2007 Sano ..... G03G 15/0865 399/258
2015/0153686 A1 6/2015 Tanaka et al.
2015/0268627 A1* 9/2015 Yokota ..... G03G 15/60 399/92
2016/0378039 A1* 12/2016 Watanabe ..... G03G 15/0849 399/30
2019/0227478 A1 7/2019 Kikura et al.
2020/0103823 A1 4/2020 Tanaka et al.
2020/0133195 A1 4/2020 Ohta et al.
2022/0365474 A1* 11/2022 Kawasumi ..... G03G 21/1619

FOREIGN PATENT DOCUMENTS

JP 2016-031449 3/2016

* cited by examiner

*Primary Examiner* — Robert B Beatty
(74) *Attorney, Agent, or Firm* — Duft & Bornsen, PC

(57) ABSTRACT

An image forming apparatus includes a fixing device, a power supply, a toner container, a cover, a first harness, and a second harness. The power supply supplies power to the fixing device. The toner container compartment is between the fixing device and the power supply and receives a toner container. The cover is on the toner container compartment and moves into the toner container compartment. The first harness is coupled to the power supply, and the second harness is coupled to the fixing device. The second harness is detachably coupled to the first harness above the cover.

10 Claims, 7 Drawing Sheets

IMAGE FORMING APPARATUS HAVING POWER SUPPLY HARNESS

CROSS-REFERENCE TO RELATED APPLICATION

This patent application is based on and claims priority pursuant to 35 U.S.C. § 119(a) to Japanese Patent Application No. 2022-025619, filed on Feb. 22, 2022, in the Japan Patent Office, the entire disclosure of which is hereby incorporated by reference herein.

BACKGROUND

Technical Field

Embodiments of the present disclosure generally relate to an image forming apparatus. Specifically, the embodiments relate to a harness coupling structure to couple a harness of a fixing device to a harness of a power supply, and the embodiments relate to the image forming apparatus having the harness coupling structure.

Related Art

An electrophotographic image forming apparatus such as a copier, a facsimile, a printer, or a multifunction peripheral includes a fixing device to fix a toner image formed on a surface of a sheet-like recording medium onto the recording medium. The fixing device is detachably attached to a body of the image forming apparatus to facilitate maintenance. The body of the image forming apparatus and the fixing device are electrically coupled to each other by a drawer connector or a harness.

SUMMARY

This specification describes an improved image forming apparatus that includes a fixing device, a power supply, a toner container, a cover, a first harness, and a second harness. The power supply supplies power to the fixing device. The toner container compartment is between the fixing device and the power supply and receives a toner container. The cover is on the toner container compartment and moves into the toner container compartment. The first harness is coupled to the power supply, and the second harness is coupled to the fixing device. The second harness is detachably coupled to the first harness above the cover.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
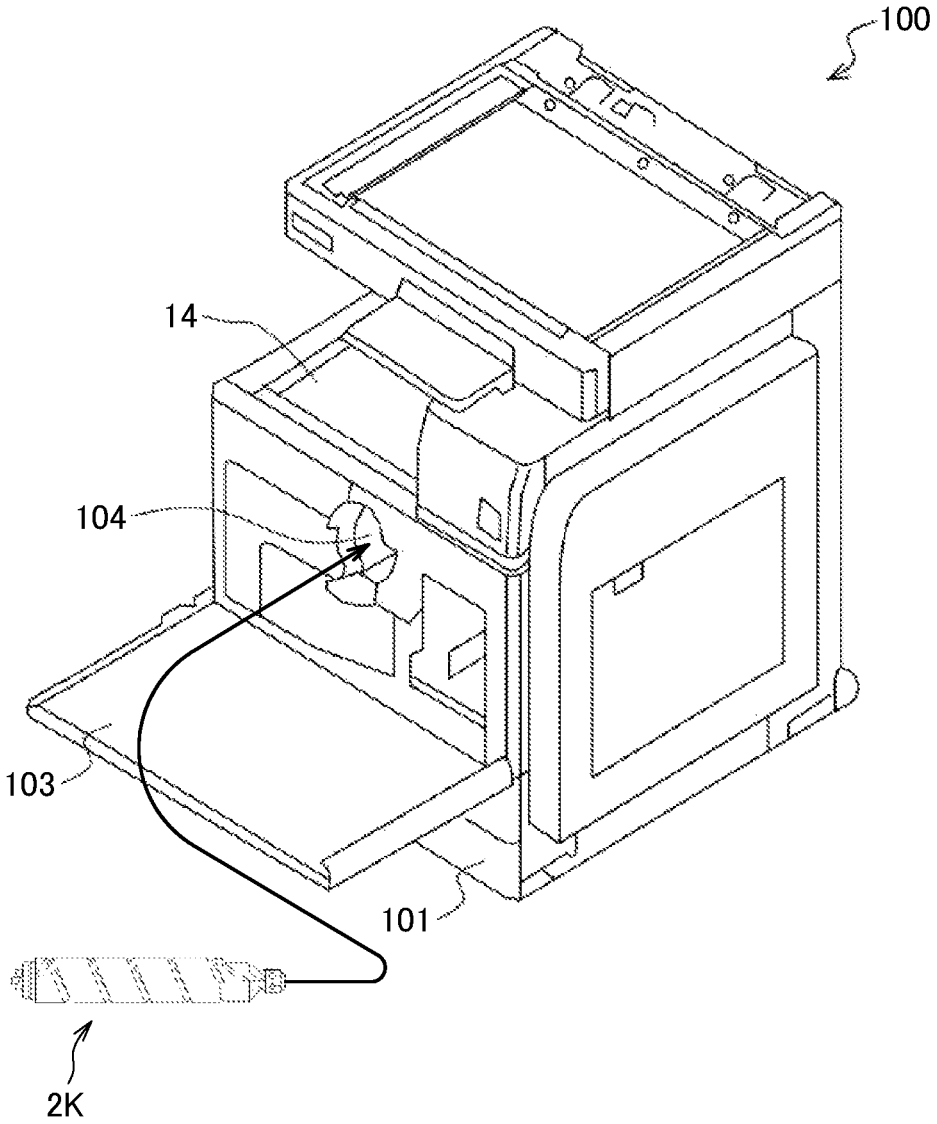
FIG. 1 is a schematic perspective view of an image forming apparatus according to an embodiment of the present disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise. Identical reference numerals are assigned to identical components or equivalents and a description of those components is simplified or omitted.

The following describes a configuration of an image forming apparatus.

FIG. 1 is a schematic perspective view of an image forming apparatus 100 according to an embodiment of the present disclosure. The image forming apparatus 100 includes a front cover 103 attached to the front side of the image forming apparatus 100. The front cover 103 can be opened and closed in the front-back direction. Opening the front cover 103 forward exposes a bottle accommodating section 104 as a toner container compartment to set a toner bottle 2K as an example of a toner container.

Figure 2:
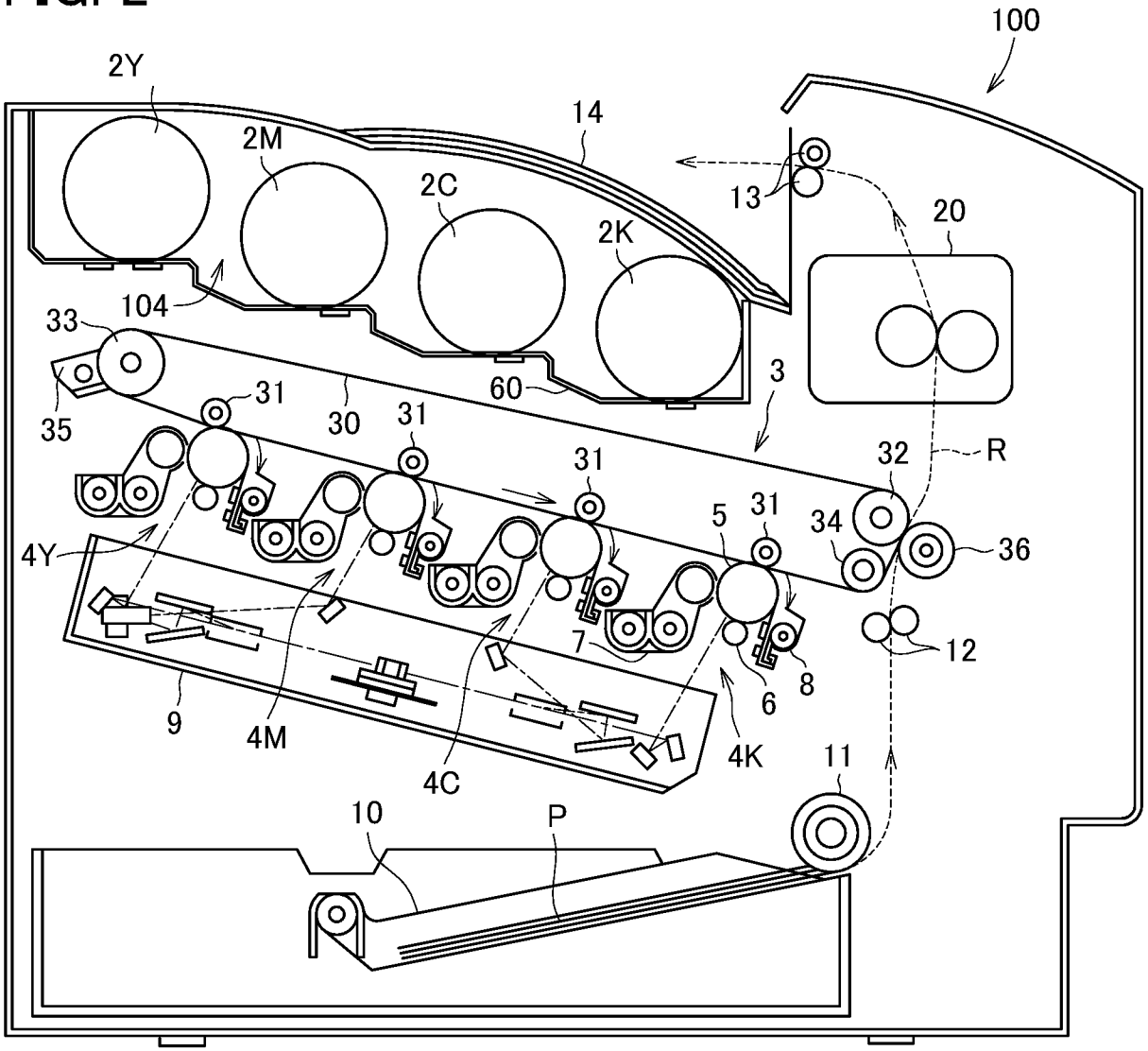
FIG. 2 is a schematic sectional view of an image forming apparatus according to an embodiment of the present disclosure.

As illustrated in FIG. 2, the image forming apparatus 100 actually includes toner bottles 2Y, 2M, 2C, and 2K including yellow (Y) toner, magenta (M) toner, cyan (C) toner, and black (K) toner, respectively. The image forming apparatus 100 includes independent bottle accommodating sections for the respective toner bottles. For simplicity, FIG. 1 illustrates the bottle accommodating section 104 for the black toner bottle 2K.

The toner bottles 2Y, 2M, 2C, and 2K contain toner to be supplied to photoconductors 5, respectively.

The image forming apparatus 100 includes image forming devices 4Y, 4M, 4C, and 4K that form toner images on the surfaces of the photoconductors 5. Forming the toner image on the surface of the photoconductor 5 reduces (in other words, consumes) the toner in each of the toner bottles 2Y, 2M, 2C, and 2K. That is, the toner bottles 2Y, 2M, 2C, and 2K are examples of consumable components that are gradually consumed each time the image forming devices 4Y, 4M, 4C, and 4K form the toner images.

The image forming apparatus 100 illustrated in FIG. 2 is a color laser printer. The four image forming devices 4Y, 4M, 4C, and 4K are in a center portion of a body of the image forming apparatus 100. The image forming devices 4Y, 4M, 4C, and 4K have substantially the same configuration except for containing different color developers (e.g., toners) of yellow (Y), magenta (M), cyan (C), and black (K), respectively, corresponding to color separation components of color images.

Specifically, each of the image forming devices 4Y, 4M, 4C, and 4K includes, e.g., the photoconductor 5 having a drum shape and serving as a latent image bearer, a charger 6 that charges the surface of the photoconductor 5, a developing device 7 that supplies toner to the surface of the photoconductor 5, and a cleaner 8 that cleans the surface of the photoconductor 5. FIG. 2 illustrates reference numerals assigned to the photoconductor 5, the charger 6, the developing device 7, and the cleaner 8 of the image forming device 4K that forms a black toner image. However, reference numerals for the image forming devices 4Y, 4C, and 4M that form yellow, cyan, and magenta toner images, respectively, are omitted for convenience.

An exposure device 9 is disposed below the image forming devices 4Y, 4M, 4C, and 4K and exposes the outer circumferential surfaces of the respective photoconductors 5 with laser beams. The exposure device 9 includes a light source, a polygon mirror, an f-O lens, and a reflection mirror to irradiate the surface of the photoconductor 5 with the laser beam according to image data.

A transfer device 3 is disposed above the image forming devices 4Y, 4M, 4C, and 4K. The transfer device 3 includes an intermediate transfer belt 30 serving as an intermediate transferor, four primary transfer rollers 31 serving as primary transfer devices.

The transfer device 3 also includes a secondary transfer roller 36 as a secondary transfer device and a secondary transfer backup roller 32. In addition, the transfer device 3 includes a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. In the present embodiment, as a driver drives and rotates the secondary transfer backup roller 32 counterclockwise, the intermediate transfer belt 30 rotates in a direction indicated by an arrow in FIG. 2.

The four primary transfer rollers 31 sandwich the intermediate transfer belt 30 together with the four photoconductors 5, forming four primary transfer nips between the intermediate transfer belt 30 and the photoconductors 5, respectively. Each primary transfer roller 31 is connected to a power supply that applies a predetermined direct current (DC) voltage and/or alternating current (AC) voltage to each primary transfer roller 31.

The intermediate transfer belt 30 is interposed between the secondary transfer roller 36 and the secondary transfer backup roller 32 to form a secondary transfer nip. Similar to the primary transfer rollers 31, the secondary transfer roller 36 is connected to the power supply that applies a predetermined direct current (DC) voltage and/or alternating current (AC) voltage to the secondary transfer roller 36.

The belt cleaner 35 includes a cleaning brush and a cleaning blade that contact an outer circumferential surface of the intermediate transfer belt 30. A waste toner conveyance tube extends from the belt cleaner 35 to an inlet of a waste toner container to convey waste toner collected from the intermediate transfer belt 30 by the belt cleaner 35 to the waste toner container.

The bottle accommodating section 104 is disposed in an upper portion of the body of the image forming apparatus 100. Four toner bottles 2Y, 2M, 2C, and 2K each containing fresh toner to be supplied to the developing device are removably mounted in the bottle accommodating section 104. The fresh toner is supplied from the toner bottles 2Y, 2M, 2C, and 2K to the respective developing devices 7 through toner supply tubes connected between the toner bottles 2Y, 2M, 2C, and 2K and the respective developing devices 7.

In a lower portion of the body of the image forming apparatus 100, a sheet feeding tray 10 and a sheet feeding roller 11 are disposed. The sheet feeding tray 10 contains sheets P as recording media. The sheet feeding roller 11 feeds the sheet P from the sheet feeding tray 10. The sheets P as the recording media may be plain paper, thick paper, postcards, envelopes, thin paper, coated paper, art paper, tracing paper, overhead projector (OHP) transparencies, and the like. Optionally, the image forming apparatus 100 may include a bypass feeder that imports such recording media placed on a bypass tray into the body of the image forming apparatus 100.

The body of the image forming apparatus 100 includes a conveyance path R to convey the sheet P from the sheet feeding tray 10 to a sheet ejection roller pair 13 via the secondary transfer nip. The sheet ejection roller pair 13 ejects the sheet P outside the body of the image forming apparatus 100. In the conveyance path R, a pair of timing rollers 12 is disposed upstream from the secondary transfer nip in a direction in which the sheet P is conveyed (hereinafter simply referred to as a sheet conveyance direction). The pair of timing rollers 12 sends out the sheet P fed from the sheet feeding roller 11 toward the secondary transfer nip at a predetermined time.

The image forming apparatus 100 includes a fixing device 20 disposed downstream from the secondary transfer roller 36 in the sheet conveyance direction. The fixing device receives the sheet P bearing the toner image and fixes the toner image onto the sheet P. On the conveyance path R downstream from the fixing device 20 in the sheet conveyance direction, the sheet ejection roller pair 13 is disposed to eject the sheet P outside the image forming apparatus 100. To stack the sheet P ejected outside the body of the image forming apparatus 100, an output tray 14 is disposed on a top surface of the image forming apparatus 100.

Next, a basic operation of the image forming apparatus 100 (illustrated as the laser printer) according to the present embodiment is described below with reference to FIG. 2.

When an image forming operation is started, the photoconductor 5 in each of the image forming devices 4Y, 4M, 4C, and 4K is driven to rotate clockwise in FIG. 2, and the charger 6 uniformly charges the surface of the photoconductor 5 in a predetermined polarity.

The exposure device 9 emits laser beams onto the charged outer circumferential surfaces of the photoconductors 5, respectively, thus forming electrostatic latent images on the photoconductors 5. The image data used to expose the respective photoconductors 5 is monochrome image data produced by decomposing a desired full color image into yellow, cyan, magenta, and black image data. The developing devices 7 supply yellow, cyan, magenta, and black toners to the electrostatic latent images formed on the photoconductors 5, visualizing the electrostatic latent images as yellow, cyan, magenta, and black toner images, respectively.

Simultaneously, as the print job starts, the secondary transfer backup roller 32 is driven and rotated counterclockwise in FIG. 2, rotating the intermediate transfer belt 30 in a rotation direction illustrated in FIG. 2 by friction therebetween. Each primary transfer roller 31 is applied with a voltage having a polarity opposite a charging polarity of the toner, in constant-voltage or constant-current control, so as to generate a transfer electrical field in each primary transfer nip between the primary transfer roller 31 and the corresponding photoconductor 5.

When the yellow, magenta, cyan, and black toner images formed on the photoconductors 5 reach the primary transfer nips, respectively, in accordance with rotation of the photoconductors 5, the transfer electric fields generated at the primary transfer nips transfer the yellow, magenta, cyan, and black toner images from the photoconductors 5 onto the intermediate transfer belt 30, respectively, such that the yellow, magenta, cyan, and black toner images are superimposed successively on the intermediate transfer belt 30. Thus, a full color toner image is formed on the outer circumferential surface of the intermediate transfer belt 30.

After the primary transfer of the yellow, cyan, magenta, and black toner images from the photoconductors 5 onto the intermediate transfer belt 30, the cleaners 8 remove residual toner failed to be transferred onto the intermediate transfer belt 30 and therefore remaining on the photoconductors 5 therefrom, respectively. Thereafter, a discharger removes the charge on the outer circumferential surface of the photoconductor 5 to ready the photoconductor 5 for the next image formation.

On the other hand, the sheet feeding roller 11 disposed in the lower portion of the image forming apparatus 100 is driven and rotated to feed the sheet P from the sheet feeding tray 10 toward the pair of timing rollers 12 through the conveyance path R. When the sheet P comes into contact with the pair of timing rollers 12, the pair of timing rollers 12 temporarily stops conveying the sheet P.

Thereafter, the pair of timing rollers 12 is rotated at a predetermined time to convey the sheet P to the secondary transfer nip in synchronization with the full-color toner image formed on the intermediate transfer belt 30 reaching the secondary transfer nip. The secondary transfer roller 36 is supplied with a transfer voltage having the polarity opposite the polarity of the charged toner contained in the full-color toner image formed on the intermediate transfer belt 30, thereby generating a transfer electric field at the secondary transfer nip.

The transfer electrical field transfers the full-color toner image from the intermediate transfer belt 30 onto the sheet P at a time. After the secondary transfer of the full color toner image from the intermediate transfer belt 30 onto the sheet P, the belt cleaner 35 removes residual toner failed to be transferred onto the sheet P and therefore remaining on the intermediate transfer belt 30 therefrom. The removed toner is conveyed and collected into a waste toner container disposed inside the image forming apparatus 100.

Thereafter, the sheet P bearing the full-color toner image is conveyed to the fixing device 20 that fixes the full-color toner image on the sheet P. The sheet P bearing the fixed full-color toner image is ejected by the sheet ejection roller pair 13 onto the outside of the image forming apparatus 100 and is stacked on the output tray 14.

The above describes the image forming operation of the image forming apparatus 100 to form the full-color toner image on the sheet P. Alternatively, the image forming apparatus 100 may form a monochrome toner image by using any one of the four image forming devices 4Y, 4C, 4M, and 4K or may form a bicolor toner image or a tricolor toner image by using two or three of the image forming devices 4Y, 4C, 4M, and 4K.

The following describes the principle of a harness coupling structure according to the present embodiment of the present disclosure.

Figure 3:
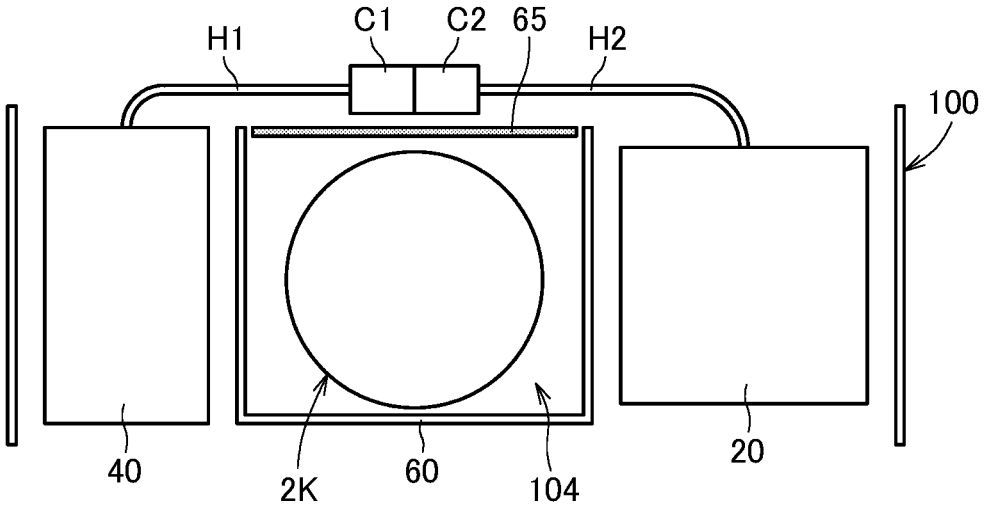
FIG. 3 is a schematic diagram illustrating the principle of a harness coupling structure to couple a harness of a fixing device to a harness of a power supply in the image forming apparatus according to the embodiment of the present disclosure.

FIG. 3 is a schematic diagram illustrating the principle of the harness coupling structure according to the present embodiment. The bottle accommodating section 104 to house the toner bottle 2K containing black toner is between the fixing device 20 and a power supply board 40 serving as a power supply. Power is supplied by controlling a current or a voltage. The bottle accommodating section 104 is surrounded by a box-shaped housing 60.

The power supply according to the present embodiment is not limited to the power supply board 40. The power supply may include a control board. The control board controls a heat generation amount generated by the heater in the fixing device 20 (in other words, power input to the heater) based on results detected by a plurality of thermistors in the fixing device 20 and raises the temperature of the heater to a predetermined temperature to perform temperature control.

FIG. 3 illustrates a general layout of the power supply board 40, the bottle accommodating section 104, and the fixing device 20 in the image forming apparatus 100. In other words, the harness coupling structure according to the present embodiment does not need changing the layout. As a result, the harness coupling structure according to the present embodiment does not increase a size of a space around the fixing device 20.

In FIG. 3, the power supply board 40, the bottle accommodating section 104, and the fixing device 20 are horizontally arranged side by side, but the present embodiment is not limited to the horizontal arrangement. The power supply board 40, the bottle accommodating section 104, and the fixing device 20 may be obliquely arranged. The harness coupling structure according to the present embodiment may be applied to the image forming apparatus 100 including the power supply board 40, the bottle accommodating section 104, and the fixing device 20 that are disposed to be inclined upward to the right or downward to the right.

The image forming apparatus 100 includes a toner bottle cover 65 as a cover above the housing 60. The toner bottle cover 65 is configured to be openable and closable.

A structure to open and close the toner bottle cover 65 may be, for example, a structure in which the toner bottle cover 65 rotates about a rotation shaft 65*a* as described below with reference to FIG. 4. However, the structure to open and close the toner bottle cover 65 is not limited this. The structure to open and close the toner bottle cover 65 may be a structure in which the toner bottle cover 65 slides in a direction perpendicular to the paper surface of FIG. 3 (in other words, the front-back direction).

Above the toner bottle cover 65, a connector C1 of a harness H1 extending from the power supply board 40 and a connector C2 of a harness H2 extending from the fixing device are detachably connected to each other. Taking out the toner bottle 2K and opening the toner bottle cover 65 downward enables access to the connectors C1 and C2.

In the present embodiment, coupling the connector C1 to the connector C2 at a position above the toner bottle 2K as illustrated in FIG. 3 gives the harness coupling structure coupling the fixing device 20 and the power supply board 40 with the shortest length. As a result, the length of the harnesses H1 and H2 can be shortened, and the cost of the harnesses H1 and H2 can be reduced.

The connector C1 may be coupled to the connector C2 below the toner bottle 2K. However, the configuration in which the connector C1 is coupled to the connector C2 at the position above the toner bottle 2K has an advantage that the connectors C1 and C2 are not contaminated with toner even if toner leaks from the toner bottle 2K.

The position at which the connector C1 is coupled to the connector C2 may be between the toner bottle 2K and the fixing device 20 or between a toner bottle and the power supply board 40. In this case, a space is designed to set the connectors on the side of the housing 60. The horizontal size of the image forming apparatus in which the connector C1 is coupled to the connector C2 at the position above the toner bottle is smaller than the horizontal size of the image forming apparatus having the space to set the connectors on the side of the housing 60. As a result, the configuration in which the connector C1 is coupled to the connector C2 at the position above the toner bottle can reduce an area to place the image forming apparatus.

The lengths of the harnesses H1 and H2 of the image forming apparatus in which the connector C1 is coupled to the connector C2 at the position above the toner bottle is shorter than the lengths of the harnesses H1 and H2 of the image forming apparatus having the space to set the connectors on the side of the housing 60. As a result, the costs of the harnesses H1 and H2 of the image forming apparatus in which the connector C1 is coupled to the connector C2 at the position above the toner bottle can be reduced. The short harness H2 simplifies a work to take out the harness H2 when the fixing device 20 is attached and detached.

In the present embodiment, the upper space of the toner bottle 2K is an empty space below the output tray 14. Effectively using this empty space as a harness coupling structure of the fixing device 20 improves accessibility to the connectors C1 and C2 without increasing the size of the image forming apparatus.

Operations opening the front cover 103, opening the toner bottle cover 65, and taking out the toner bottle 2K are simple operations performed by a user and do not require special tools. The harness coupling structure according to the present embodiment using the space for the toner bottle can enlarge a space for operations to couple the connector C2 to the connector C1, shorten an access time to the connectors C1 and C2 and reduce man-hours for the operations.

A drawer connector disposed on the back side of the image forming apparatus may be used instead of the harness coupling structure according to the above-described embodiment to detachably couple harnesses when the fixing device is detached from and attached to the image forming apparatus. However, the drawer connector is expensive.

Figure 9:
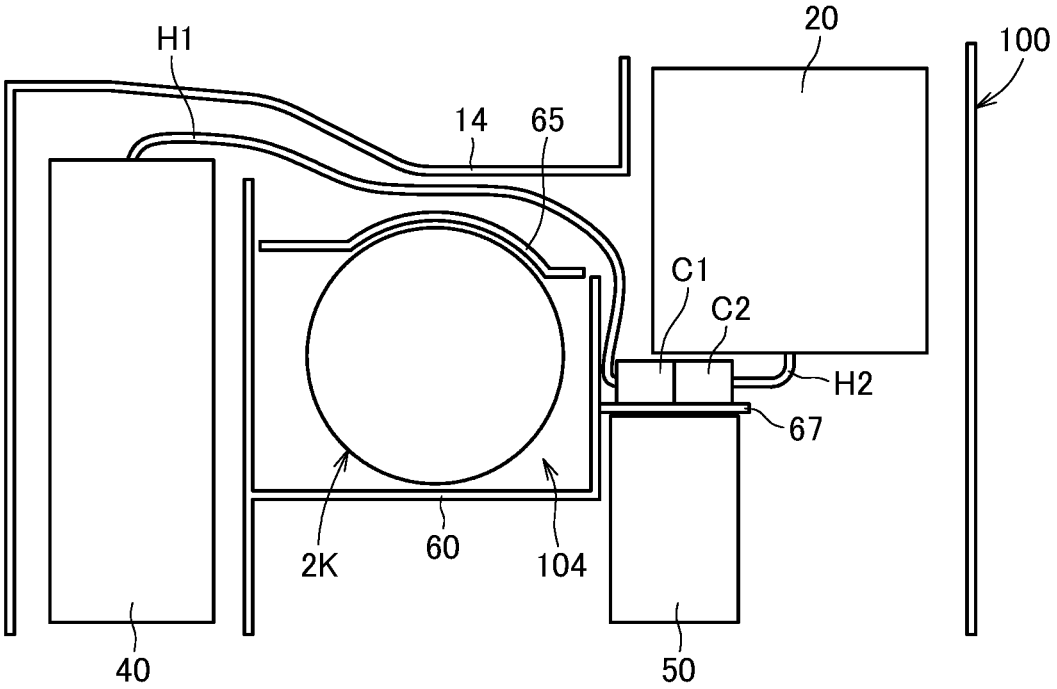
FIG. 9 is a schematic diagram illustrating a harness connection structure according to a comparative embodiment.

Alternatively, as illustrated in FIG. 9, the connector C1 of the harness H1 coupled to the power supply board 40 may be coupled to the connector C2 of the harness H2 coupled to the fixing device 20 at a position in the vicinity of a replacement part such as a photoconductor development unit (PCDU) 50. However, this structure requires additional work for removing the replacement part, for example, work for pulling out a connector between the PCDU 50 and the body of the image forming apparatus and work for taking out the PCDU 50 from the body of the image forming apparatus. As a result, this structure increases operations and time to access the connectors C1 and C2. The work for removing the replacement part may damage a part of the replacement part, for example, the photoconductor in the PCDU 50. In contrast, the harness coupling structure according to the above-described embodiment uses the space for setting the toner bottle. Since the user sets the toner bottle in the image forming apparatus, the image forming apparatus is designed to facilitate access to the space for setting the toner bottle. As a result, the harness coupling structure according to the present embodiment provides easy access to the connector.

A first embodiment is described below with reference to FIG. 4.

Figure 4:
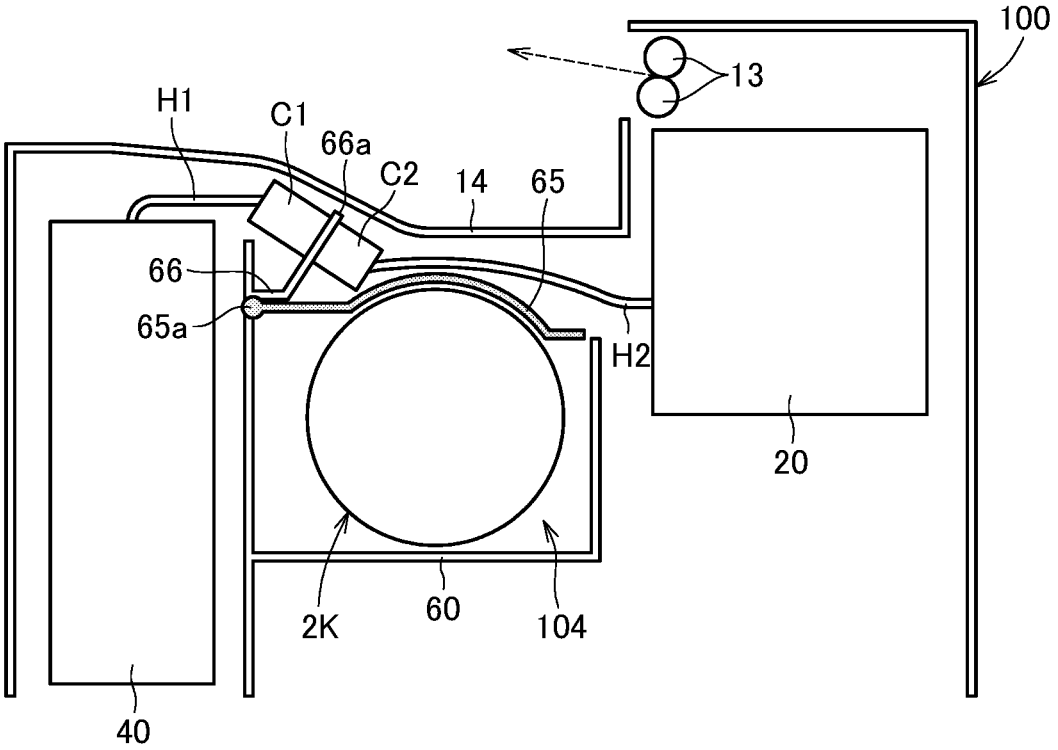
FIG. 4 is a schematic diagram illustrating the harness coupling structure according to a first embodiment.

FIG. 4 is a schematic diagram illustrating the harness coupling structure according to the first embodiment. One end of the toner bottle cover 65 is supported by the housing 60 via the rotation shaft 65*a*. The rotation shaft 65*a* rotatably supports the one end of the toner bottle cover 65.

A support 66 is disposed on a side of the housing 60. The toner bottle cover 65 is supported by the side of the housing 60. The support 66 includes a connector support 66*a*. The connector support 66*a* extends obliquely upward to the right from a position adjacent to the rotation shaft 65*a*, that is, a position of the housing 60 close to the power supply board 40. In other words, the connector support 66*a* is inclined to have an upper end nearer to the fixing device 20 than to the power supply board 40 and a lower end nearer to the power supply board 40 than to the fixing device 20. The connector C1 of the harness H1 coupled to the power supply board 40 is fixed to the left side of the connector support 66*a*.

As described above, the connector support 66*a* is preferably inclined upward to the right. The connector support 66*a* inclined upward to the right directs the outlet of the connector C1 of the harness H1 obliquely downward to the right.

This orientation of the outlet of the connector C1 is convenient for inserting the connector C2 into the connector C1. In addition, positioning the base end of the connector support 66*a* adjacent to the rotation shaft 65*a* enlarges a space extending in a direction for inserting the connector C2 into the connector C1. As a result, the harness coupling structure in the first embodiment can facilitate inserting the connector C2 into the connector C1.

A second embodiment is described below with reference to FIG. 5.

Figure 5:
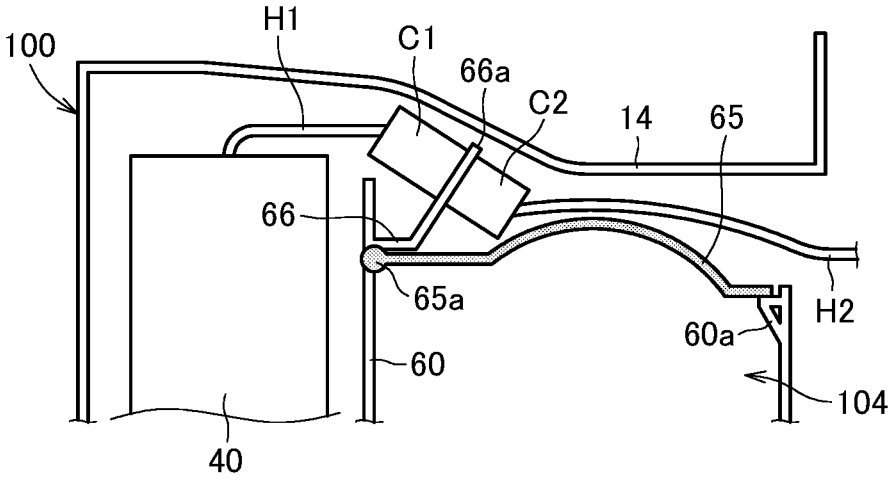
FIG. 5 is a schematic diagram illustrating the harness coupling structure according to a second embodiment.

FIG. 5 is a schematic diagram illustrating the harness coupling structure according to the second embodiment. One end of the toner bottle cover 65 is supported by the housing 60 via the rotation shaft 65*a*.

The other end of the toner bottle cover 65 is configured to engage a hook 60*a* included in the housing 60. The hook 60*a* and the other end of the toner bottle cover 65 has a snap-fit structure. The other end of the toner bottle cover 65 snap on the hook 60*a*. The above-described structure enables one touch quick operation to open and close the toner bottle cover 65 and improves the accessibility to the connectors C1 and C2.

A lateral positional relationship between the rotation shaft 65*a* and the hook 60*a* in FIG. 5 may be reversed. That is, the rotation shaft 65*a* is disposed on the right side of the housing 60, and the hook 60*a* is disposed on the left side of the housing 60. Similar to the structure illustrated in FIG. 5, the above-described structure can improve the accessibility to the connectors C1 and C2.

To improve visibility, the hook 60*a* may have a color different form colors of other portions (for example, the hook 60*a* may have a fluorescent color). In addition, the hook 60*a* may be in the vicinity of the front end of the bottle accommodating section 104, which enables an operator to easily access the hook 60*a* and improves the workability.

The hook 60*a* has elasticity so as to elastically deform in the lateral direction in FIG. 5. In order to open the toner bottle cover 65 downward, the operator pushes the hook 60*a* outward (in other words, rightward in FIG. 5), which easily releases the snap-fit engagement (lock) that engages the toner bottle cover 65 to the housing 60. As a result, the connector C2 of the fixing device 20 can be quickly attached to and detached from the connector C1 of the power supply board 40, and the fixing device 20 can be easily attached to and detached from the body of the image forming apparatus 100.

Figure 6A:
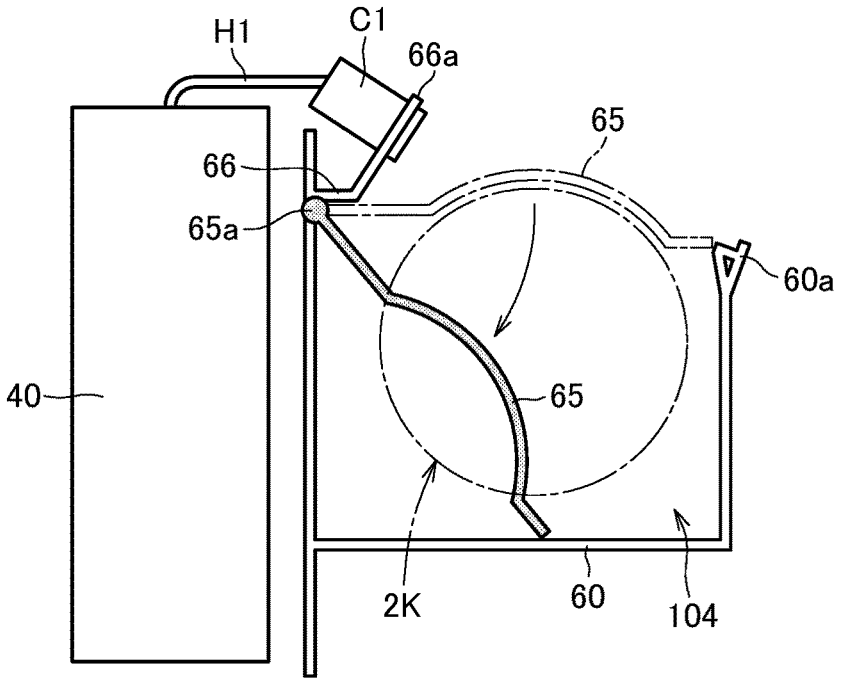
FIG. 6A is a schematic diagram illustrating a state before the harness of the fixing device is coupled to the harness of the power supply.
Figure 6B:
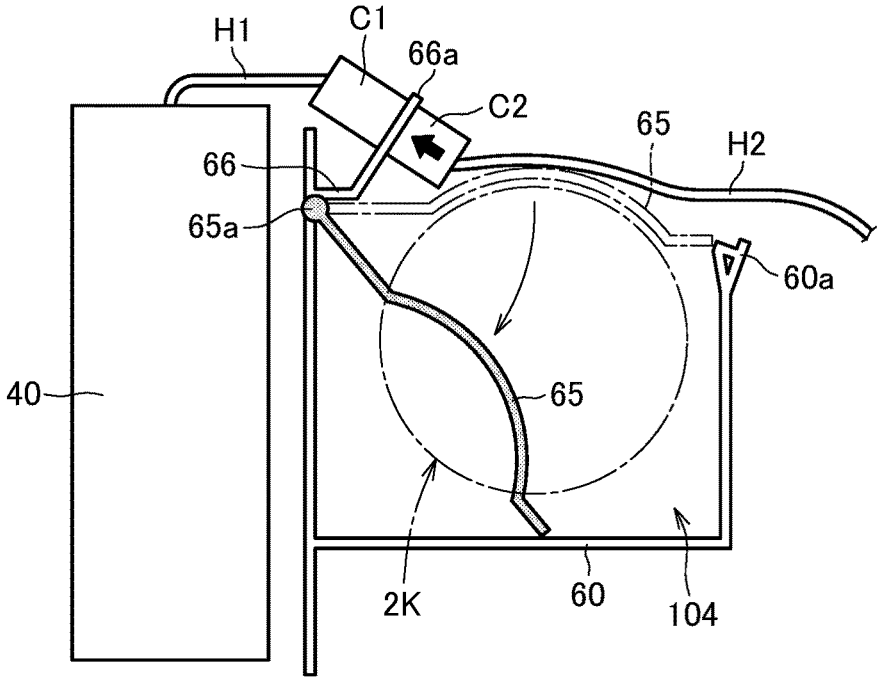
FIG. 6B is a schematic diagram illustrating a state after the harness of the fixing device is coupled to the harness of the power supply.

The following describes how the connector C2 of the fixing device 20 is attached to the connector C1 of the power supply board 40 with reference to FIGS. 6A and 6B.

As illustrated in FIG. 6A, after the toner bottle 2K is removed from the bottle accommodating section 104, the toner bottle cover 65 is rotated downward about the rotation shaft 65*a* to be opened.

As a result, the connector C1 of the power supply board 40 is exposed to the bottle accommodating section 104. The operator can access the connector C1 through the space of the bottle accommodating section 104.

Next, the operator installs the fixing device 20 into the body of the image forming apparatus 100 and couples the connector C2 of the harness H2 extending from the fixing device 20 to the connector C1 of the power supply board 40 in a direction indicated by an arrow in FIG. 6B, that is, the direction inclined upward from the right to the left in FIG. 6B. The connector support 66*a* inclined upward from the left to the right in FIG. 6B defines the direction indicated by the arrow in FIG. 6B in which the connector C2 is coupled to the connector C1, which gives an advantage that the bottle accommodating section 104 can be effectively used as a working space.

After the connector C2 is coupled to the connector C1, the toner bottle cover 65 is rotated upward about the rotation shaft 65*a*, and the other end of the toner bottle cover 65 is snapped on the hook 60*a*.

Thus, the toner bottle cover 65 is closed again. Finally, the toner bottle 2K is inserted into the bottle accommodating section 104, and the front cover 103 in FIG. 1 is closed. As a result, the fixing device 20 and the image forming apparatus 100 becomes operable.

The toner bottle cover 65 opened as illustrated in FIG. 6B interferes with the toner bottle 2K if the operator tries to insert the toner bottle 2K into the bottle accommodating section 104. As a result, the operator cannot set the toner bottle 2K in the bottle accommodating section 104.

In other words, until the operator closes the toner bottle cover 65, the operator cannot set the toner bottle 2K in the bottle accommodating section 104. Thus, the above-described configuration can prevent the operator from forgetting to close the toner bottle cover 65.

In the above-described embodiments, the connector support 66*a* is fixed to the housing 60.

The connector support 66*a* helps the operator easily set the connector C2 to the mating connector C1. However, the connector support 66*a* is not always indispensable. As illustrated in FIG. 3, The structure without the connector support 66*a* also enables coupling the connector C2 to the connector C1.

The connector support 66*a* may be disposed not on the housing 60 but on the upper surface of the toner bottle cover 65. The connector support 66*a* disposed on the upper surface of the toner bottle cover 65 may slightly lengthen the harnesses H1 and H2 but gives an advantage that the visibility of the connectors C1 and C2 is improved.

Figure 7:
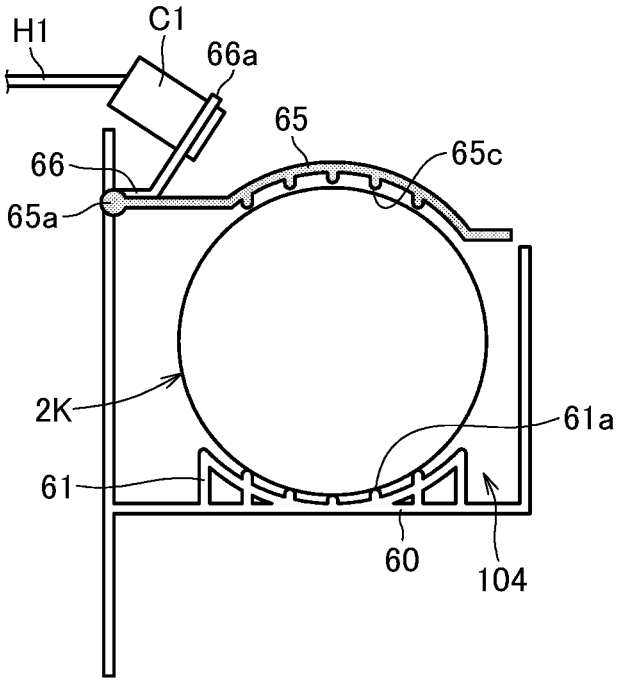
FIG. 7 is a schematic view of a toner bottle cover including ribs and a bottle receiver including ribs to guide a toner bottle and parts relating the toner bottle cover.

A third embodiment is described below with reference to FIG. 7. The image forming apparatus according to the third embodiment includes a bottle receiver 61 as a toner container receiver on which the toner bottle 2K is disposed. The bottle receiver 61 is in the housing 60. As illustrated in FIG. 7, ribs 61*a* are formed on the upper surface of the bottle receiver 61, and ribs 65*c* are formed on the lower surface of the toner bottle cover 65. The ribs 61*a* and 65*c* reduces resistance of the toner bottle 2K inserted into and removed from the bottle accommodating section 104. Facilitating insertion and removal of the toner bottle 2K can further enhance ease of access to the connectors C1 and C2.

Figure 8A:
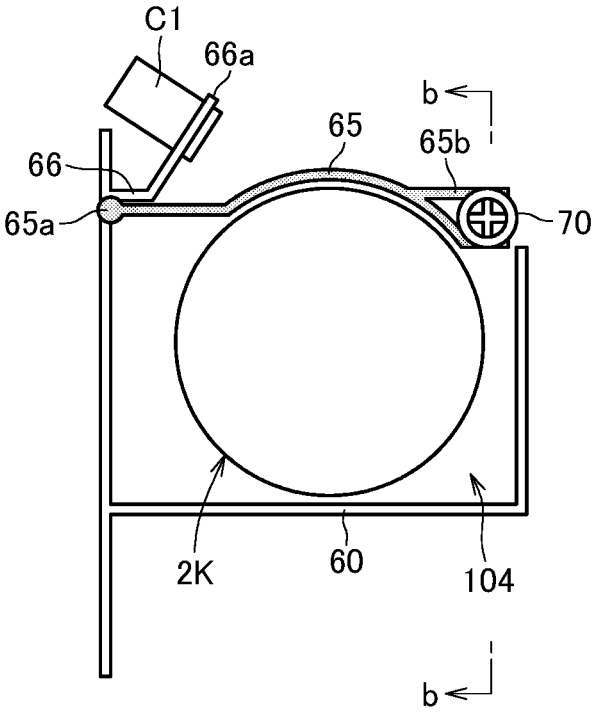
FIG. 8A is a schematic view of a structure including a screw to fix the toner bottle cover on a housing.
Figure 8B:
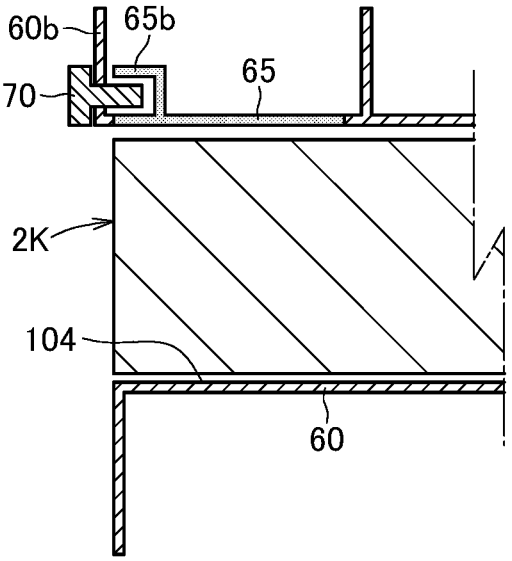
FIG. 8B is a schematic cross-sectional view taken along line b-b in FIG. 8A.

A fourth embodiment is described below with reference to FIG. 8. In the fourth embodiment, a screw 70 fixes the toner bottle cover 65 on the housing 60. In a configuration including the harness H1 coupled to a primary power supply not through a current breaker, the user is preferably prevented from carelessly accessing the connector C1 of the power supply board 40. The screw 70 fixing the toner bottle cover 65 on the housing 60 prevents the user from carelessly accessing the connector C1.

The toner bottle cover 65 has a bifurcated portion 65*b* at the other end opposite to the rotation shaft 65*a*. The housing 60 has a screw receiver 60*b*. The tip of the screw 70 is inserted into a space between the bifurcated portion 65*b* and screwed into the screw receiver 60*b* to fix the toner bottle cover 65. Smoothing a surface of the screw 70 in contact with the bifurcated portion 65*b* avoids damage to the bifurcated portion 65*b* even if the toner bottle cover 65 is made of resin.

In order to facilitate attachment of the screw 70, the housing 60 may have the above-described hook 60*a*. Since the hook 60*a* supports the toner bottle cover 65, supporting the toner bottle cover 65 by hand is not needed to attach the screw 70 to the housing 60. The screw 70 may be a hand screw with a knurled screw head or a special screw that can be rotated with a special tool.

The above-described embodiments are illustrative and do not limit this disclosure. It is therefore to be understood that within the scope of the appended claims, numerous additional modifications and variations are possible to this disclosure otherwise than as specifically described herein. For example, the image forming apparatus to which the features of this disclosure are applied is not limited to the printer illustrated in FIG. 1 but may be other type printers, copiers, facsimile machines, or multifunction machines having these capabilities.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. An image forming apparatus comprising:

a fixing device;

a power supply configured to supply power to the fixing device;

a toner container compartment between the fixing device and the power supply, the toner container compartment configured to receive a toner container;

a cover on the toner container compartment, the cover configured to move into the toner container compartment;

a first harness coupled to the power supply; and a second harness coupled to the fixing device, the second harness detachably coupled to the first harness above the cover.

2. The image forming apparatus according to claim 1, wherein the cover is on a top of the toner container compartment.

3. The image forming apparatus according to claim 1, further comprising a housing defining the toner container compartment.

4. The image forming apparatus according to claim 1, further comprising a rotation shaft rotatably supporting one end of the cover.

5. The image forming apparatus according to claim 1, further comprising a hook engaging one end of the cover.

6. The image forming apparatus according to claim 3, further comprising a screw fixing an end of the cover to the housing.

7. The image forming apparatus according to claim 1, further comprising a connector support supporting the first harness and the second harness, the connector support being inclined and having an upper end nearer to the fixing device than to the power supply and a lower end nearer to the power supply than to the fixing device.

8. The image forming apparatus according to claim 7, further comprising a rotation shaft rotatably supporting one end of the cover, wherein the connector support has a base end adjacent to the rotation shaft.

9. The image forming apparatus according to claim 1, wherein the cover includes ribs.

10. The image forming apparatus according to claim 1, further comprising a toner container receiver including ribs.

* * * * *